US010861354B2

(12) United States Patent
Nahm et al.

(10) Patent No.: US 10,861,354 B2
(45) Date of Patent: Dec. 8, 2020

(54) PERFORATED, COMBINED RECEIPT AND LABEL ROLL

(71) Applicant: Iconex LLC, Duluth, GA (US)

(72) Inventors: Steven Nahm, Morristown, TN (US); Robert McDaniel, Rogersville, TN (US)

(73) Assignee: Iconex LLC, Duluth, GA (US)

( * ) Notice: Subject to any disclaimer, the term of this patent is extended or adjusted under 35 U.S.C. 154(b) by 0 days.

(21) Appl. No.: 16/385,874

(22) Filed: Apr. 16, 2019

(65) Prior Publication Data

US 2019/0244549 A1 Aug. 8, 2019

Related U.S. Application Data

(60) Division of application No. 15/710,487, filed on Sep. 20, 2017, now Pat. No. 10,297,172, which is a (Continued)

(51) Int. Cl.
*B42D 15/00* (2006.01)
*G09F 3/10* (2006.01)
(Continued)

(52) U.S. Cl.
CPC ..... *G09F 3/10* (2013.01); *G09F 3/0286* (2013.01); *G09F 3/0288* (2013.01);
(Continued)

(58) Field of Classification Search
CPC ..... B42D 15/00; G09F 3/10; G09F 3/0286; G09F 3/0288; G09F 2003/0211; G09F 2003/0229; G09F 2003/0269
See application file for complete search history.

(56) References Cited

U.S. PATENT DOCUMENTS 1,949,903 A 3/1934 Fales
4,312,523 A 1/1982 Haines
(Continued)

FOREIGN PATENT DOCUMENTS

FR 2759306 A1 8/1998

OTHER PUBLICATIONS

"U.S. Appl. No. 13/222,278, Advisory Action dated Mar. 10, 2014", 3 pgs.
"U.S. Appl. No. 13/222,278, Advisory Action dated Oct. 22, 2014", 3 pgs.
"U.S. Appl. No. 13/222,278, Final Office Action dated Aug. 6, 2014", 18 pgs.
(Continued)

*Primary Examiner* — Nguyen Q. Ha
(74) *Attorney, Agent, or Firm* — Schwegman Lundberg & Woessner, P.A.

(57) ABSTRACT

A receipt and label roll comprises a core and a web having a longitudinally-extending axis and wound on the core along the axis. The web includes (i) a substrate having a front side and a back side opposite the front side, (ii) a thermally-sensitive coating disposed on the front side of the substrate, (iii) adhesive disposed on a portion of the back side of the substrate along the web axis, and (iv) a release coating disposed on the front side of the substrate along the web axis to prevent the adhesive from sticking to the front side of the substrate when the web is wound on the core. The web further includes (v) a longitudinal weakened structure extending along a direction parallel to the web axis and dividing the web into a first web portion on which the adhesive is disposed and a second web portion which is substantially devoid of adhesive.

2 Claims, 6 Drawing Sheets

Related U.S. Application Data division of application No. 15/338,999, filed on Oct. 31, 2016, now Pat. No. 9,852,665, which is a continuation of application No. 14/741,850, filed on Jun. 17, 2015, now Pat. No. 9,483,962, which is a continuation of application No. 13/222,278, filed on Aug. 31, 2011, now Pat. No. 9,082,321.

(51) Int. Cl.
*G09F 3/00* (2006.01)
*G09F 3/02* (2006.01)

(52) U.S. Cl.
CPC .... *G09F 3/0297* (2013.01); *G09F 2003/0201* (2013.01); *G09F 2003/0211* (2013.01); *G09F 2003/0229* (2013.01); *G09F 2003/0248* (2013.01); *G09F 2003/0269* (2013.01)

(56) References Cited

U.S. PATENT DOCUMENTS

| | | | | |
|---|---|---|---|---|
| 5,056,827 | A | 10/1991 | Sasso | |
| 5,366,087 | A * | 11/1994 | Bane | G09F 3/0288 206/459.5 |
| 5,578,352 | A | 11/1996 | Smith | |
| 5,782,496 | A | 7/1998 | Casper et al. | |
| 5,914,165 | A * | 6/1999 | Freedman | B32B 7/06 428/40.1 |
| 6,145,423 | A | 11/2000 | Boreali et al. | |
| 6,244,629 | B1 | 6/2001 | Chess | |
| 6,268,032 | B1 * | 7/2001 | Mertens | B42D 5/003 283/81 |
| 6,364,364 | B1 | 4/2002 | Murphy | |
| 7,329,449 | B2 * | 2/2008 | Wiklof | B41J 3/4075 283/81 |
| 8,846,171 | B2 | 9/2014 | Godfrey et al. | |
| 8,857,085 | B1 | 10/2014 | Lewis | |
| 9,082,321 | B2 | 7/2015 | Nahm et al. | |
| 9,483,962 | B2 | 11/2016 | Nahm et al. | |
| 9,607,531 | B2 | 3/2017 | Weidauer et al. | |
| 2002/0170465 | A1 * | 11/2002 | Scholz | C09J 7/21 106/287.11 |
| 2007/0095221 | A1 | 5/2007 | Lee | |
| 2007/0234618 | A1 * | 10/2007 | Adams | G09F 3/0288 40/638 |
| 2007/0267146 | A1 | 11/2007 | Vigunas et al. | |
| 2011/0180616 | A1 | 7/2011 | Ito | |
| 2012/0234481 | A1 | 9/2012 | Raming | |
| 2015/0279242 | A1 * | 10/2015 | Parks | G09F 3/10 428/41.7 |
| 2015/0287347 | A1 | 10/2015 | Nahm | |
| 2017/0046987 | A1 | 2/2017 | Nahm et al. | |
| 2018/0012522 | A1 | 1/2018 | Nahm et al. | |

OTHER PUBLICATIONS

"U.S. Appl. No. 13/222,278, Final Office Action dated Dec. 30, 2013", 23 pgs.
"U.S. Appl. No. 13/222,278, Non Final Office Action dated Apr. 24, 2014", 18 pgs.
"U.S. Appl. No. 13/222,278, Non Final Office Action dated Nov. 17, 2014", 12 pgs.
"U.S. Appl. No. 13/222,278, Response filed Feb. 17, 2015 to Non Final Office Action dated Nov. 17, 2014", 6 pgs.
"U.S. Appl. No. 13/222,278, Response filed Feb. 28, 2014 to Final Office Action dated Dec. 30, 2013", 9 pgs.
"U.S. Appl. No. 13/222,278, Response filed Jul. 24, 2014 to Non Final Office Action dated Apr. 24, 2014", 9 pgs.
"U.S. Appl. No. 13/222,278, Response filed Oct. 6, 2014 to Final Office Action dated Aug. 6, 2014", 8 pgs.
"U.S. Appl. No. 13/222,278, Response filed Nov. 6, 2014 to Final Office Action dated Aug. 6, 2014", 8 pgs.
"U.S. Appl. No. 14/741,850, Final Office Action dated Apr. 13, 2016", 16 pgs.
"U.S. Appl. No. 14/741,850, Non Final Office Action dated Dec. 22, 2015", 25 pgs.
"U.S. Appl. No. 14/741,850, Notice of Allowance dated Jul. 6, 2016", 6 pgs.
"U.S. Appl. No. 14/741,850, Preliminary Amendment filed Jun. 17, 2015", 6 pgs.
"U.S. Appl. No. 14/741,850, Response filed Mar. 22, 2016 to Non Final Office Action dated Dec. 22, 2015", 10 pgs.
"U.S. Appl. No. 14/741,850, Response filed Jun. 14, 2016 to Final Office Action dated Apr. 13, 2016", 7 pgs.
"U.S. Appl. No. 15/338,999, Non Final Office Action dated May 11, 2017", 23 pgs.
"U.S. Appl. No. 15/338,999, Notice of Allowance dated Aug. 18, 2017", 6 pgs.
"U.S. Appl. No. 15/338,999, Preliminary Amendment filed Oct. 31, 2016", 3 pgs.
"U.S. Appl. No. 15/338,999, Response filed Aug. 2, 2017 to Non Final Office Action dated May 11, 2017", 6 pgs.
"U.S. Appl. No. 15/338,999, Supplemental Preliminary Amendment filed Nov. 30, 2016", 5 pgs.
"U.S. Appl. No. 15/710,487, Non Final Office Action dated Sep. 26, 2018", 25 pgs.
"U.S. Appl. No. 15/710,487, Notice of Allowance dated Jan. 24, 2019", 12 pgs.
"U.S. Appl. No. 15/710,487, Preliminary Amendment filed Sep. 20, 2017", 3 pgs.
"U.S. Appl. No. 15/710,487, Response to Non Final Office Action dated Sep. 26, 2018 filed Dec. 26, 2018", 10 pgs.
"U.S. Appl. No. 15/710,487, Supplemental Preliminary Amendment filed Sep. 21, 2017", 5 pgs.

* cited by examiner

PERFORATED, COMBINED RECEIPT AND LABEL ROLL

RELATED APPLICATIONS

This application is a divisional Patent Application Serial No. 15/710,487, filed Sep. 20, 2017, which is a divisional of U.S. Patent Application Serial No. 15/338,999, filed. Oct. 31, 2016, which is a continuation of U.S. patent application Ser. No. 14/741,850, filed Jun. 17, 2015, now U.S. Pat. No. 9,483,962, Issuing on Nov. 1, 2016, which is a continuation of U.S. Patent Application Serial No. 13/222,278 filed Aug. 31, 2011, now U.S. Pat. No. 9,082,321, Issued on Jul. 14, 2015, the disclosures of which are incorporated herein by reference.

BACKGROUND

The present application relates to combined receipt and label rolls, and is particularly directed to a perforated, combined receipt and label roll.

A known combined receipt and label roll 10 is shown in FIGS. 1-3. The combined roll 10 comprises a continuous web 12 of material wound in a spiral around a core 14. The web 12 includes a substrate 16 (FIG. 3) having a front side 18 and a back side 20 opposite the front side. A pattern of adhesive spots or strips 22 are disposed on the back side 20 of the substrate 16. The adhesive pattern 22 covers a relatively small portion of the back side 20, and extends along a longitudinal running axis 24 (FIG. 2) of the web 12.

A thermal-sensitive coating 26 is disposed on the entire front side 18 of the substrate 16. A release coating 28 is disposed on the thermal sensitive coating 26, and is also disposed on the entire front side 18 of the substrate layer 16. The release coating 28 prevents adhesive 22 on the back side 20 of the substrate 16 from sticking to the front side 18 when the web 12 is wound on the core 14.

During use of the combined roll 10 of FIGS. 1-3 in a direct thermal printer (not shown), the printer thermally images a portion of the thermal-sensitive coating layer 26 to provide receipt information on the thermally-imaged portion. A movable cutting blade of the printer then cuts the web 12 in cross-section to provide a combined receipt and label 30 as shown in FIG. 4. Alternatively, the web 12 may be cut in cross-section by a user manually tearing it against a stationary cutting blade of the printer to provide the combined receipt and label 30.

In an example use of the combined receipt and label 30 of FIG. 4, a retail merchant (such as a fast food restaurant) attaches the combined receipt and label 30 by way of the adhesive 22 to a purchased item (such as an order made by a retail customer in the fast food restaurant). The attached combined receipt and label 30 functions as a temporary label for the merchant to identify the order to be delivered to the particular customer. After the customer receives the order from the merchant, the customer removes the combined receipt and label 30 and keeps it as a permanent receipt of the order transaction.

A limitation of the permanent receipt 30 shown in FIG. 4 is that it contains adhesive 22 which can stick to clothing, wallets or purses, other documents, and the like. Moreover, the permanent receipt 30 is unable to be folded without adhesive inside the folded receipt. Another limitation of the permanent receipt 30 is that the customer (or the merchant) is unable to write anything in ink onto the front side 18 (FIG. 3) of the substrate 16 since the release coating 28 is not ink-receptive and is disposed on the entire front side of the substrate. It would be desirable to provide a permanent receipt in which such limitations are overcome.

SUMMARY

In accordance with one embodiment, a receipt and label roll comprises a core and a web having a longitudinally-extending axis and wound on the core along the axis. The web includes (i) a substrate having a front side and a back side opposite the front side, (ii) a thermally-sensitive coating disposed on the front side of the substrate, (iii) adhesive disposed on a portion of the back side of the substrate along the web axis, and (iv) a release coating disposed on the front side of the substrate along the web axis to prevent the adhesive from sticking to the front side of the substrate when the web is wound on the core. The web further includes (v) a longitudinal weakened structure extending along a direction parallel to the web axis and dividing the web into a first web portion on which the adhesive is disposed and a second web portion which is substantially devoid of adhesive.

DETAILED DESCRIPTION

Figure 6:
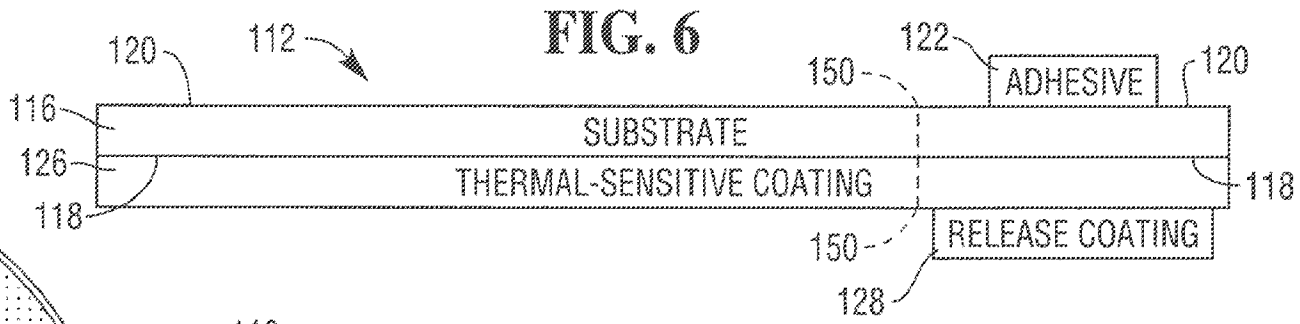
FIG. 6 is a cross-sectional view, taken approximately along line 6-6 shown in FIG. 5, and showing layers of material of the combined receipt and label roll.
Figure 5:
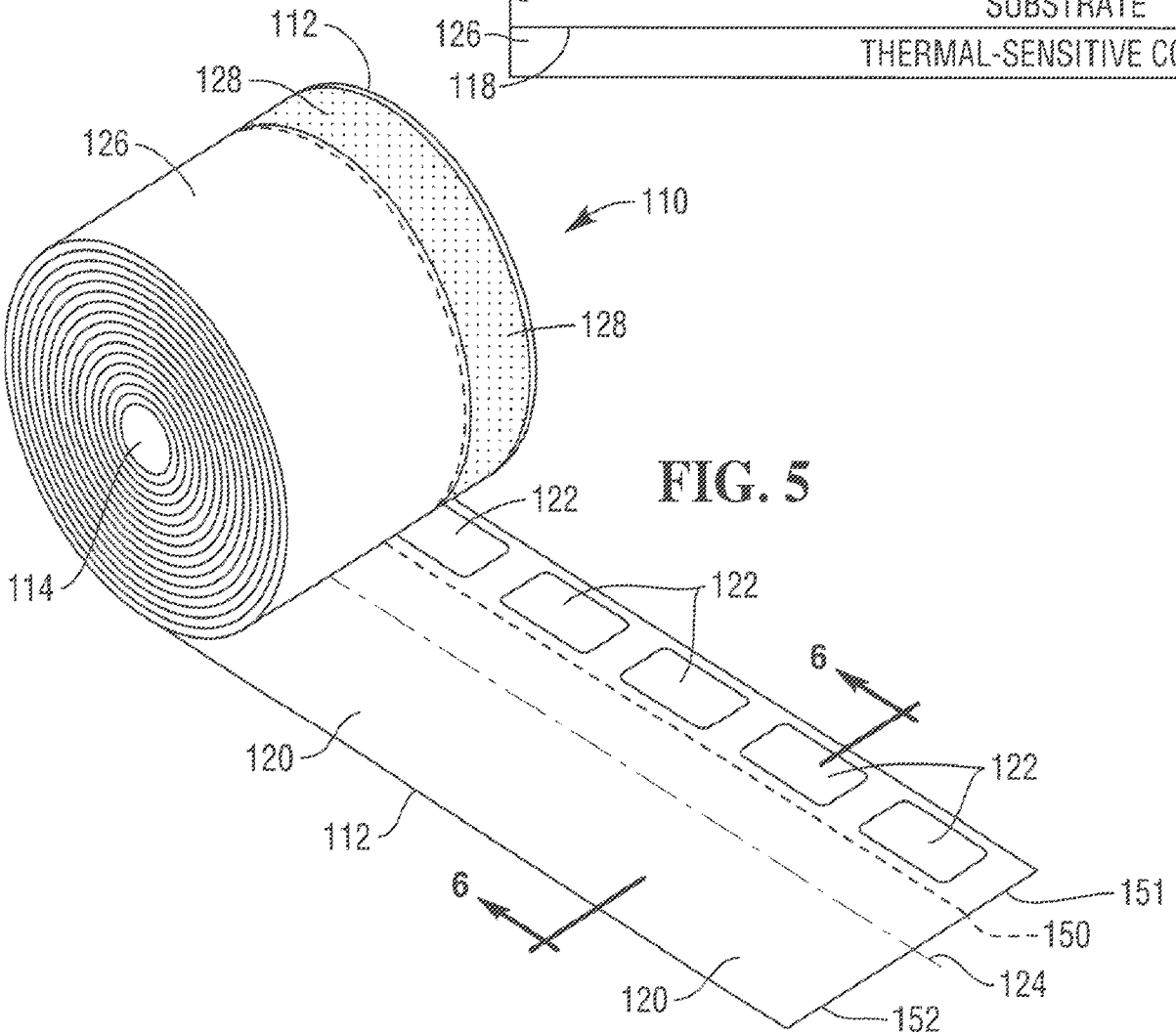
FIG. 5 is a perspective view similar to the perspective view of FIG. 2, and showing a combined receipt and label roll constructed in accordance with one embodiment.

Referring to FIGS. 5 and 6, example combined receipt and label roll 110 includes a web 112 of material having a longitudinally-extending axis 124 along a longitudinally-running direction of the web. The web 112 of material is wound on core 114 along web axis 124.

Web 112 includes substrate 116 having front side 118 and back side 120 opposite the front side. A pattern of adhesive 122, in the form of spots or strips for example, is disposed on a portion of the back side 120 of substrate 116 along web axis 124. Thermally-sensitive coating 126 is disposed on an area covering the entire front side 118 of substrate 116. The pattern of adhesive 122, as shown in FIG. 5, is only an example pattern. It is conceivable that other adhesive patterns, or any combination of adhesive patterns, may be used.

Release coating 128 is disposed on the front side 118 of substrate 116 along web axis 124 to prevent adhesive from sticking to the front side 118 of substrate 116 when web 112 is wound on core 114. Release coating 128 may be disposed on the entire front side 118 of substrate 116, or on only a portion of the front side 118 of substrate 116, such as shown in FIGS. 5 and 6. As shown in the embodiment of FIGS. 5 and 6, location of release coating 116 on the front side 118 of substrate 116 corresponds to location of adhesive spots or strips 122 on the back side 120 of substrate 116 to prevent adhesive from sticking to the front side 118 of substrate 116.

A weakened structure 150 in the form of a longitudinal perforation extends along a direction parallel to web axis 124. Longitudinal perforation 150 divides web 112 into a first web portion 151 and a second web portion 152. Adhesive 122 and release coating 128 are disposed on first web portion 151. Second web portion 152 is substantially devoid of adhesive and release coating.

It should be noted that the longitudinal perforation 150 shown in FIG. 5 divides first and second web portions 151, 152 into unequal-sized portions. It is conceivable that longitudinal perforation 150 may be located at a position different from the position shown in FIG. 5. As an example, longitudinal perforation 150 shown in FIG. 5 may be at a location which divides first and second web portions 151, 152 into equal-sized portions.

Also, although the weakened structure 150 is described above as a longitudinally-extending perforation, it is conceivable that another type of weakened structures may be used. For example, the weakened structure 150 may comprise a narrow portion of substrate which is relatively thinner in cross-section than the rest of the substrate.

Figure 7:
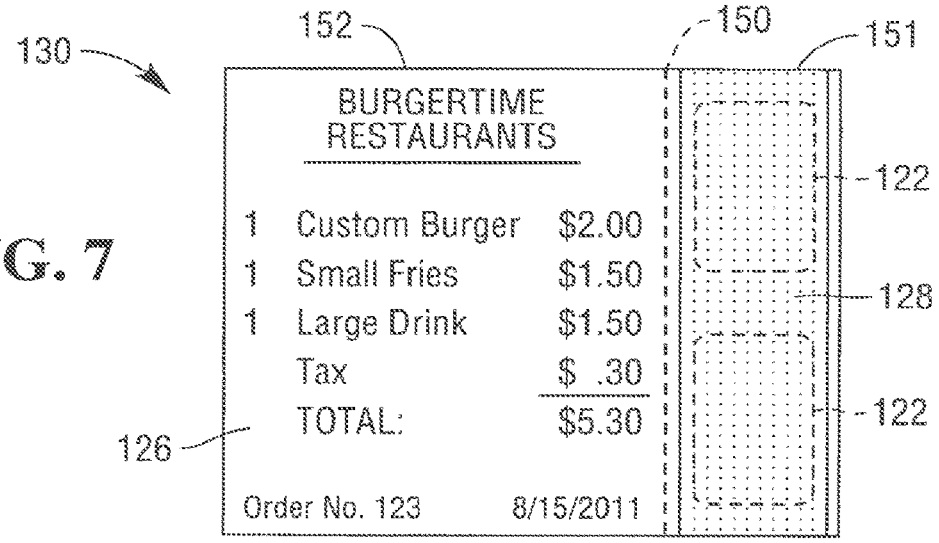
FIG. 7 is a front view of a combined receipt and label cut from the combined receipt and label roll of FIGS. 5 and 6.

During use of example combined receipt and label roll 110 of FIGS. 5 and 6, a direct thermal printer (not shown) thermally images a portion of thermal-sensitive coating 126 to provide receipt information on the thermally-imaged portion. A movable cutting blade (also not shown) of the printer then cuts web 112 in cross-section to provide combined receipt and label 130 as shown in FIG. 7. Alternatively, web 112 may be cut in cross-section by a user (such as a retail merchant) manually tearing it against a stationary cutting blade of the printer to provide the combined receipt and label 130.

Figure 4:
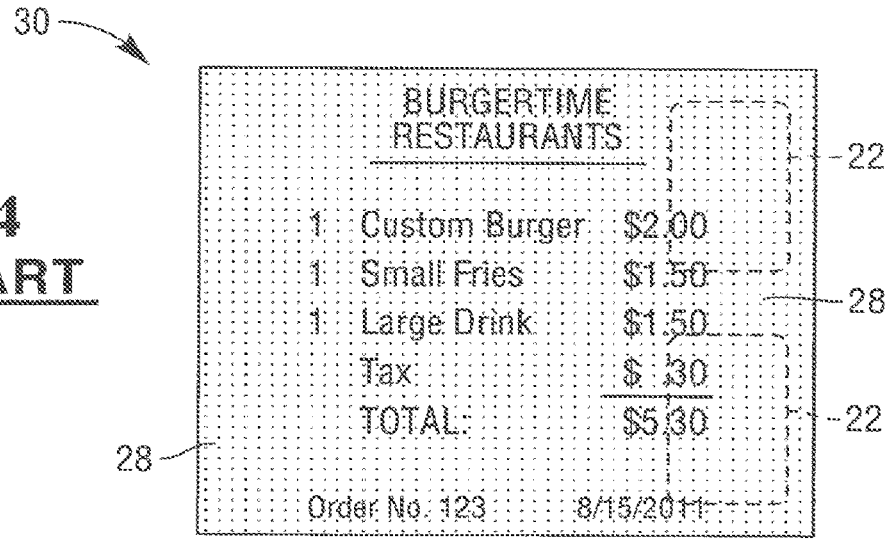
FIG. 4 PRIOR ART
FIG. 4 is a front view of a combined receipt and label which has been cut from the known combined receipt and label roll of FIGS. 1-3.

It should be noted that the receipt information shown in FIG. 7 is printed in a position different from the position of the receipt information shown in FIG. 4. The receipt information of FIG. 7 is printed such that all of the receipt information is printed to only the left (as viewed looking at FIG. 7) of the perforation 150. It should also be noted that the surface portion of the front side 118 of the substrate 116 to the left of the perforation 150 is devoid of release coating material, and that the surface portion of the hack side 120 of the substrate to the left of the perforation 150 is devoid of adhesive material.

In an example use of the combined receipt and label 130 of FIG. 7, a retail merchant (such as a fast food restaurant) attaches combined receipt and label 130 by way of adhesive 122 to a purchased item (such as an order made by a retail customer in the fast food restaurant). The attached combined receipt and label 130 functions as a temporary label for the merchant to identify the order to be delivered to the particular customer.

Figure 8:
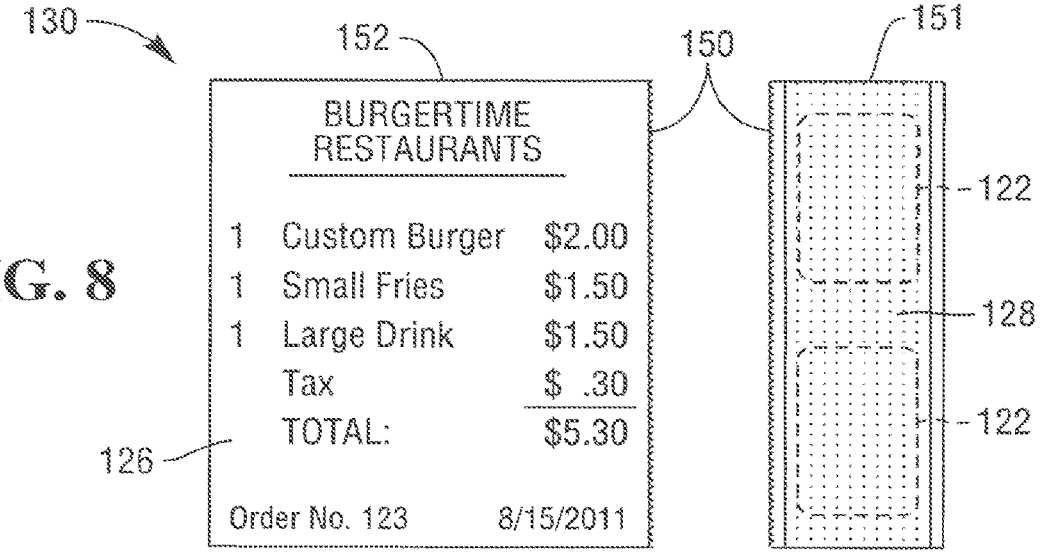
FIG. 8 is a front view similar to FIG. 7, and showing the combined receipt and label separated into two portions.

After the customer receives the order from the merchant, the customer manually tears combined receipt and label 130 along longitudinal perforation 150 to separate apart the first and second web portions 151, 152 of the combined receipt and label, as shown in FIG. 8. The customer keeps second web portion 152 of combined receipt and label 130 as a permanent receipt of the order transaction. The customer may leave first web portion 151 on the order. Alternatively, the customer may remove first web portion 151 from the order and discard it.

Although the above description describes receipt information being printed only to the left of the perforation 150 and no information at all being printed to the right of the perforation 150 (i.e., the right remains blank), it is conceivable that at least some information be printed to the right. It is conceivable that all information to the right be different from the left, or that only some of the information be different. It is also conceivable that all information to the right be identical with information on the left.

Figure 2:
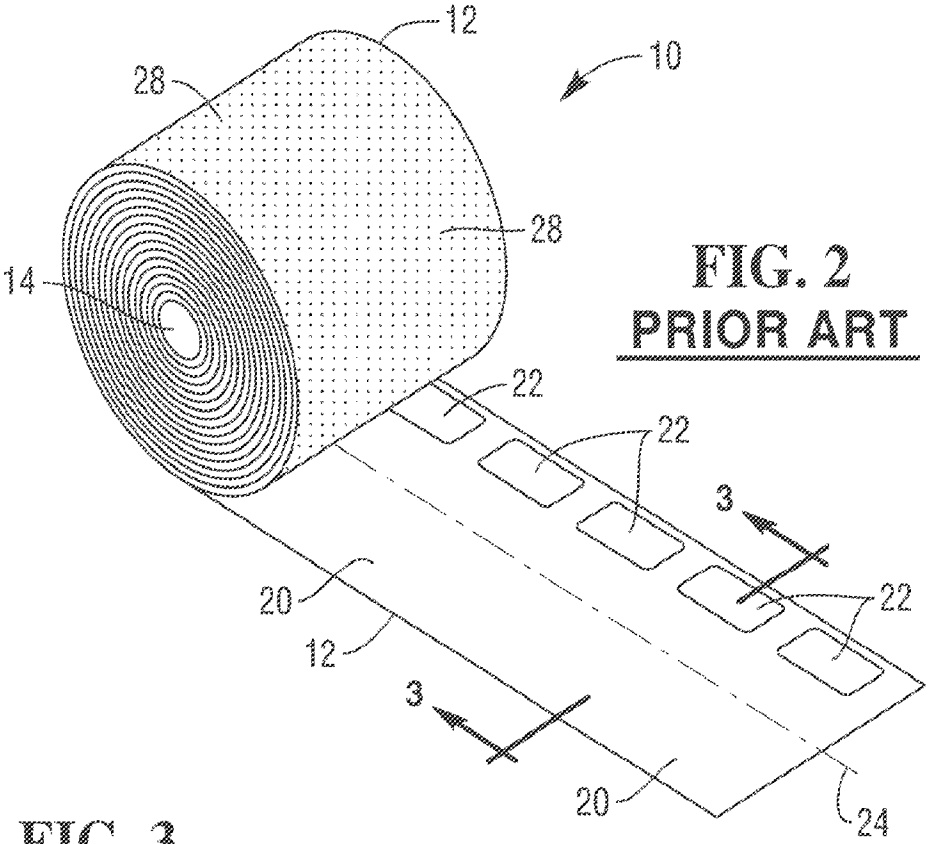
FIG. 2 PRIOR ART
FIG. 2 is a perspective view, looking generally in the direction of arrow A shown in FIG. 1, and showing back side of the known combined receipt and label roll.
Figure 1:
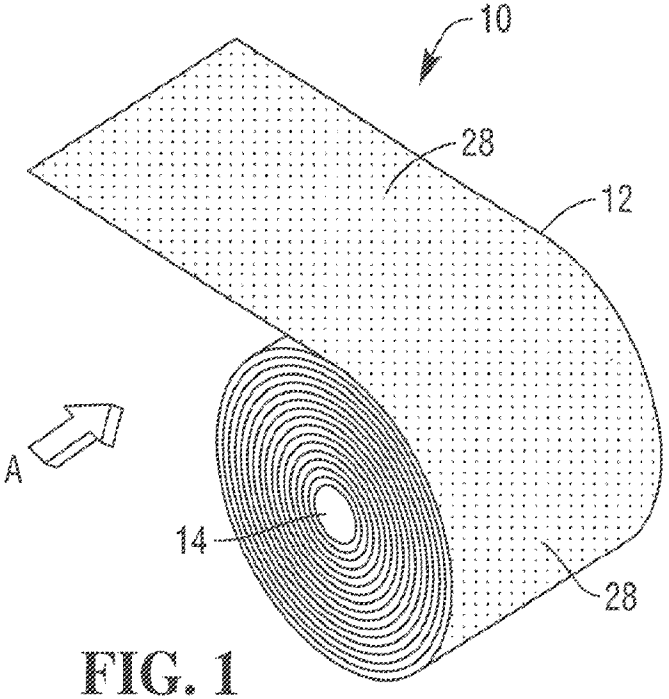
FIG. 1 PRIOR ART
FIG. 1 is a perspective view of a known combined receipt and label roll, and showing front side of the roll.
Figure 3:
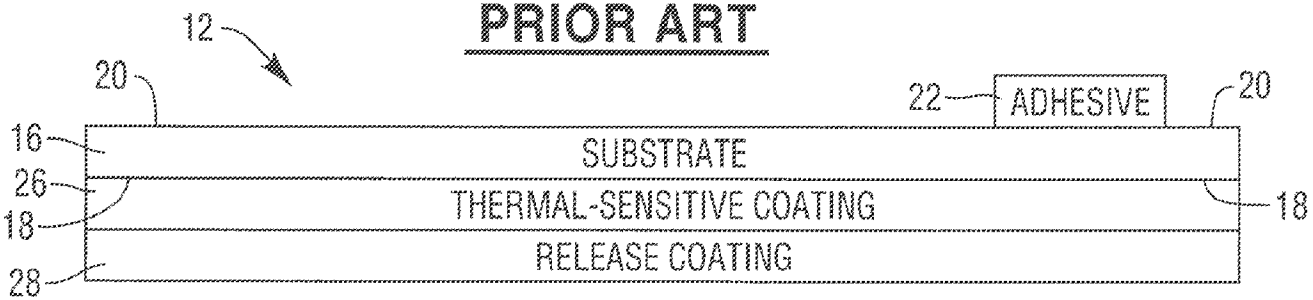
FIG. 3 PRIOR ART
FIG. 3 is a cross-sectional view, taken approximately along line 3-3 shown in FIG. 2, and showing layers of material of the known combined receipt and label roll.

Also, although the above description describes the lettering-size of the receipt information the left of the perforation 150 in FIG. 7 as being the same lettering-size shown in FIG. 1, it is conceivable that the lettering-size shown in FIG. 7 be either smaller or larger than that shown in FIG. 4. In the case where receipt information is printed to the left of the perforation 150 of FIG. 7 and at least some information is printed to the right of the perforation 150, the lettering-size on the left may be different from the lettering-size on the right. Alternatively, the lettering-sizes may be the same.

Moreover, the orientation of the text of the receipt information need not be restricted to the traditional orientation (i.e., across the narrow dimension of the receipt). It is conceivable that at least some (or all) of the text of the receipt information may be oriented parallel to the web axis 124.

It should be apparent that a single roll of web material provides a combined receipt and label in which a temporary label is initially provided and then a permanent receipt is provided. In the example fast food order described above, the first and second web portions 151, 152 initially function together as a "temporary label" which can be attached by the merchant by way of adhesive 122 to the order. The temporary label allows the merchant to identify the order to which the particular temporary label is attached.

After the second web portion 152 is separated from the first web portion 151 (as shown in FIG. 8), the second web portion 152 functions as a "permanent receipt" which is free of adhesive. By providing a permanent receipt which is free of adhesive, the permanent receipt does not stick to clothing, wallets or purses, other documents, and the like. Also, the permanent receipt can be folded without adhesive inside the folded receipt.

It should also be apparent that the longitudinal perforation 150 is a weakened part of the web 112 which allows the second web portion 152 to be easily separated by the customer (or by the merchant) from the first web portion 151.

It should be apparent that the permanent receipt can be signed using ink. This feature is provided because that portion of the front side 118 of the substrate 116 which is devoid of release coating (see FIG. 6) comprises ink-receptive material on which ink can be applied and adhered to. Thermally-sensitive coating 126 may comprise ink-receptive material. Alternatively, ink-receptive material may be disposed on the thermally-sensitive coating 126.

It should further be apparent that a merchant needs to have only one printer to use the combined receipt and label roll 130. Two printers, one printer for printing a label and another printer for printing a receipt, are not needed.

Figure 9:
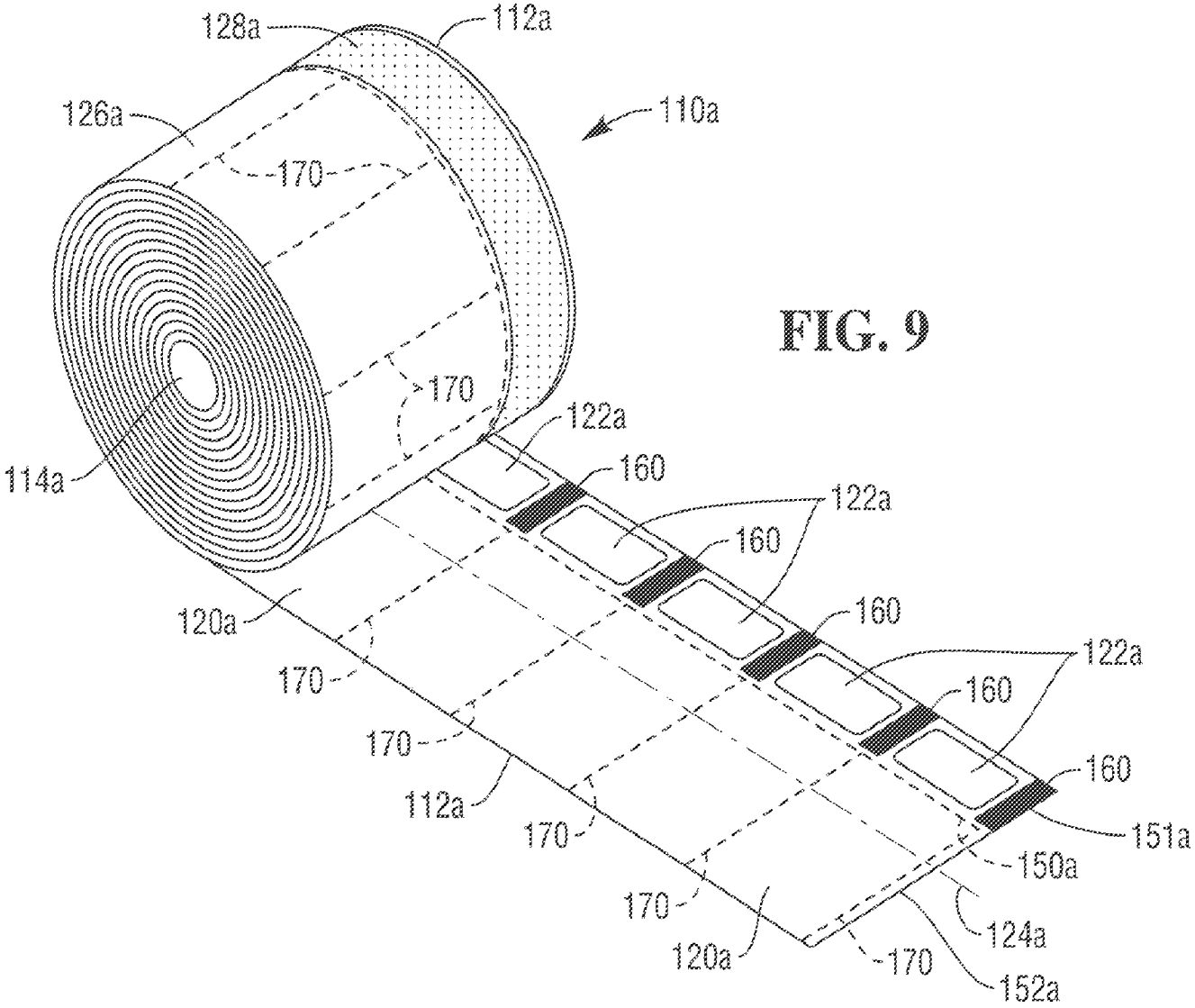
FIG. 9 is a perspective view similar to the perspective view of FIG. 5, and showing a combined receipt and label roll constructed in accordance with another embodiment.

Another embodiment is illustrated in FIG. 9. Since the embodiment illustrated in FIG. 9 is generally similar to the embodiment illustrated in FIG. 5, similar numerals are utilized to designate similar components, the suffix letter "a" being associated with the embodiment of FIG. 9 to avoid confusion.

Thermally-sensitive coating 126*a* is disposed on an area covering the entire front side. Release coating 128*a* is disposed on a portion of the front side. Longitudinal perforation 150*a* extends between first and second web portions 151*a*, 152*a*.

A number of cross-sectional perforations 170 extend across web 112*a* between spots or strips of adhesive 122*a* disposed on web 112*a* which is wound core 114*a* along web axis 124*a* of roll 110*a* as shown in FIG. 9. Cross-sectional perforations 170 are spaced apart from each other along web 112*a* in a direction parallel to web axis 124*a*. Each of the cross-sectional perforations 170 extends along a cross-sectional direction which is transverse to the longitudinal-extending direction of web axis 124*a*.

Sense marks 160 are printed on the back side 120*a*. Color of sense marks 160 may be black, for example. Sense marks 160 are disposed on cross-sectional perforations 170 as illustrated in FIG. 9. Locations of sense marks 160 on the back side 120*a* correspond to locations between the spots or strips of adhesive 122*a*. Sense marks 160 indicate locations of cross-sectional perforations 170, and tell the printer where to cut. As an example, the printer may cut at a location where a cross-sectional perforation is not located. It is conceivable though that the printer may cut at a location on a cross-sectional perforation.

Although sense marks 160 are shown in FIG. 9 as being on the back side 120*a*, it is conceivable that the sense marks 160 be on the front side. Also, sense marks 160 may be on the left edge or the right edge.

Although corresponding sense marks 160 are shown in FIG. 9 as being located between all adhesive spots or strips 122*a*, it is conceivable sense marks be located between only some of the adhesive spots or strips 122*a*. Similarly, cross-sectional perforations 170 may be located between only some of the adhesive spots or strips 122*a*. Moreover, it is conceivable that locations of sense marks 160 between certain spots or strips 122*a* may be different from locations of cross-sectional perforations 170 between other adhesive spots or strips 122*a*.

Although the embodiment shown in FIG. 9 includes both cross-sectional perforations 170 and sense marks 160, it is conceivable that other embodiments include only cross-sectional perforations or only sense marks.

Figure 10:
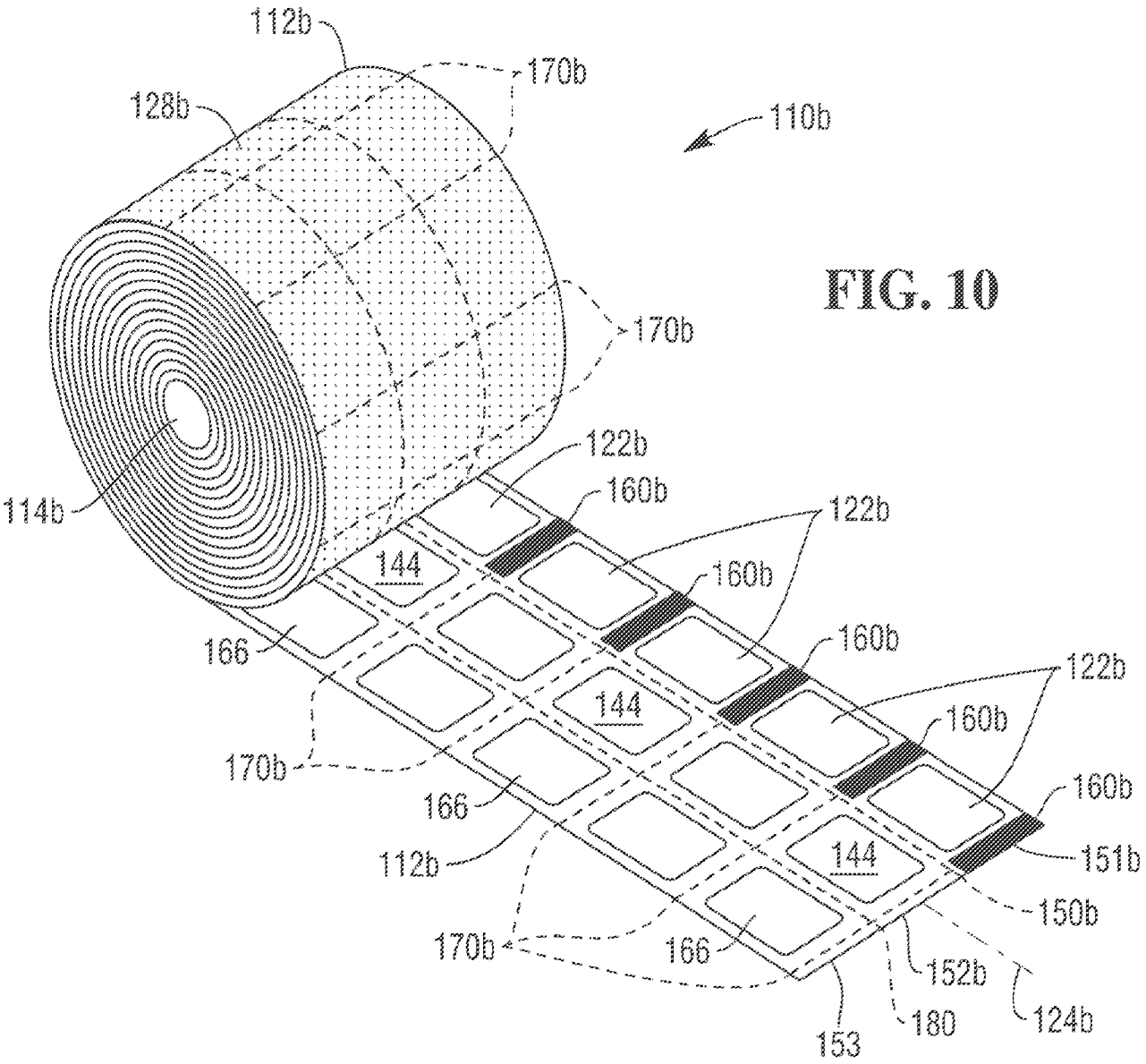
FIGS. 10-11 are perspective views similar to the perspective view of FIG. 9, and showing other embodiments.

Another embodiment is illustrated in FIG. 10. Since the embodiment illustrated in FIG. 10 is generally similar to the embodiment illustrated in FIG. 9, similar numerals are utilized to designate similar components, the suffix letter "b" being associated with the embodiment of FIG. 10 to avoid confusion.

Thermally-sensitive coating (not shown) is disposed on an area covering the front side. Release coating 128*b* is disposed on the front side. First longitudinal perforation 150*b* extends between first web portion 151*b* and second web portion 152*b*. Second longitudinal perforation 180 extends between second web portion 152*b* and third web portion 153.

Spots or strips of adhesive 122*b* are disposed on first web portion 151*b*. Spots or strips of adhesive 144 are disposed on second web portion 152*b*. Spots or strips of adhesive 166 are disposed on third web portion 153. First, second, and third web portions 151*b*, 152*b*. 153 form web 112*b* which is wound core 114*b* along web axis 124*b* of roll 110*b* as shown in FIG. 10. The pattern of adhesive 122*b*, as shown in FIG. 10, is only an example pattern. It is conceivable that other adhesive patterns, or any combination of adhesive patterns, may be used.

A number of cross-sectional perforations 170*b* extend across web 112*b* between adhesives 122*b*, 144, 166. Cross-sectional perforations 170*b* are spaced apart from each other along web 112*b* in a direction parallel to web axis 124*b*. Each of the cross-sectional perforations 170*b* extends along a cross-sectional direction which is transverse to the longitudinal-extending direction of web axis 124*b*.

Although only two longitudinal perforations 150*b*, 180 are shown in FIG. 10, it is conceivable that there be more than two longitudinal perforations. Also, although each of the first, second, and third web portions 151*b*, 152*b*, 153 shown in FIG. 10 includes adhesive thereon, it is conceivable that only some of the web portions include adhesive thereon. For example, only one of the three web portions 151*b*. 152*b*, 153 may include adhesive thereon while the remaining two web portions are adhesive-free. As another example, only two of the three web portions 151*b*, 152*b*, 153 may include adhesive thereon, while the remaining web portion is adhesive-free.

Sense marks 160*b* are printed on the back side. Color of sense marks 160*b* may be black, for example. Sense marks 160*b* are disposed on cross-sectional perforations 170*b* as illustrated in FIG. 10. Locations of sense marks 160*b* on the back side correspond to locations between adhesives 122*b*. 144, 166. Sense marks 160*b* indicate locations of cross-sectional perforations 170*b*, and tell the printer where to cut. Although sense marks 160*b* are shown in FIG. 10 as being on the back side, it is conceivable that the sense marks 160*b* be on the front side. Also, sense marks 160*b* may be on the left edge or the right edge.

Although corresponding sense marks 160*b* are shown in FIG. 10 as being located between all adhesive spots or strips, it is conceivable that sense marks be located between only some adhesive spots or strips. Similarly, cross-sectional perforations 170*b* may be located between only some adhesive spots or strips. Moreover, it is conceivable that locations of sense marks 160*b* between certain adhesive spots or strips may be different from locations of cross-sectional perforations 170*b* between other adhesive spots or strips.

Although the embodiment shown in FIG. 10 includes both cross-sectional perforations 170*b* and sense marks 160*b*, it is conceivable that other embodiments include only cross-sectional perforations or only sense marks.

Figure 11:
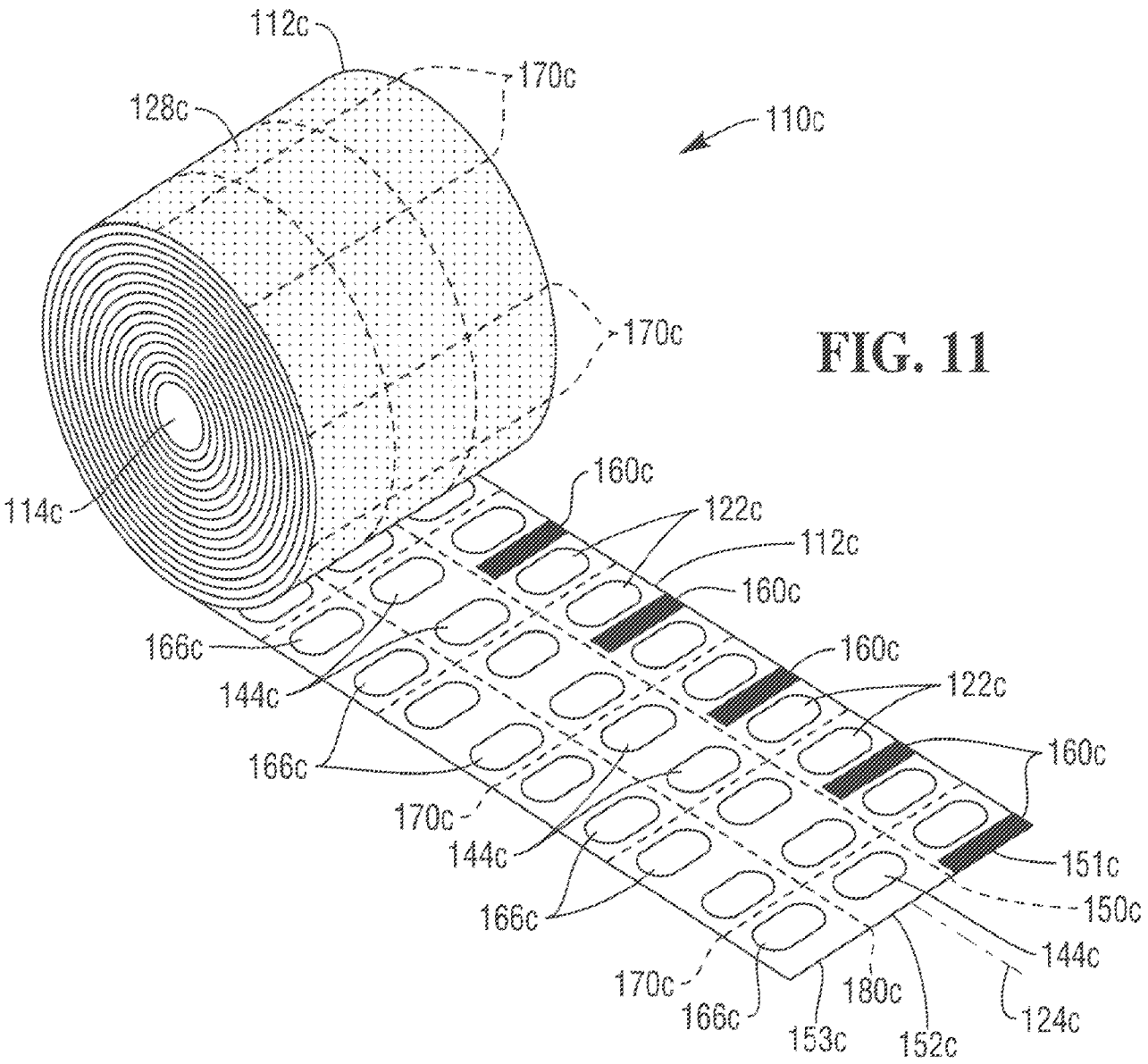

Another embodiment is illustrated in FIG. 11. Since the embodiment illustrated in FIG. 11 is generally similar to the embodiment illustrated in FIG. 10, similar numerals are utilized to designate similar components, the suffix letter "c" being associated with the embodiment of FIG. 11 to avoid confusion.

Thermally-sensitive coating (not shown) is disposed on an area covering the front side. Release coating 128*c* is disposed on the front side. First longitudinal perforation 150*c* extends between first web portion 151*c* and second web portion 152*c*. Second longitudinal perforation 180*c* extends between second web portion 152*c* and third web portion 153*c*.

Spots or strips of adhesive 122*c* are disposed on first web portion 151*c*. Spots or strips of adhesive 144*c* are disposed on second web portion 152*c*. Spots or strips of adhesive 166*c* are disposed on third web portion 153*c*. First, second, and third web portions 151*c*. 152*c*, 153*c* form web 112*c* which is wound core 114*c* along web axis 124*c* of roll 110*c* as shown in FIG. 11. Each of the pattern of adhesive 122*c*, the pattern of adhesive 144*c*, and the pattern of adhesive

166*c*, as shown in FIG. 11, is only an example pattern. It is conceivable that each of the adhesive patterns may be a different adhesive pattern.

A number of cross-sectional perforations 170*c* extend across web 112*c* between adhesives 122*c*, 144*c*, 166*c*. Cross-sectional perforations 170*c* are spaced apart from each other along web 112*c* in a direction parallel to web axis 124*c*. Each of the cross-sectional perforations 170*c* extends along a cross-sectional direction which is transverse to the longitudinal-extending direction of web axis 124*c*.

Although only two longitudinal perforations 150*c*, 180*c* are shown in FIG. 11, it is conceivable that there be more than two longitudinal perforations. Also, although each of the first, second, and third web portions 151*c*, 152*c*, 153*c* shown in FIG. 1*c* includes adhesive thereon, it is conceivable that only some of the web portions include adhesive thereon. For example, only one of the three web portions 151*c*, 152*c*, 153*c* may include adhesive thereon while the remaining two web portions are adhesive-free. As another example, only two of the three web portions 1551*c*. 152*c*, 153*c* may include adhesive thereon, while the remaining web portion is adhesive-free.

Sense marks 160*c* are printed on the back side. Color of sense marks 160*c* may be black, for example. Sense marks 160*c* are disposed between cross-sectional perforations 170*c* as illustrated in FIG. 11. Locations of sense marks 160*c* on the back side correspond to locations between certain adhesive spots or strips 122*c* on first web portion 151*c*. Sense marks 160*c* indicate locations of cross-sectional perforations 170*c*, and tell the printer where to cut. Although sense marks 160*c* are shown in FIG. 11 as being on the back side, it is conceivable that the sense marks 160*c* be on the front side. Also, sense marks 160*c* may be on the left edge or the right edge.

Although the embodiment shown in FIG. 11 includes both cross-sectional perforations 170*c* and sense marks 160*c*, it is conceivable that other embodiments include only cross-sectional perforations or only sense marks.

While the present invention has been illustrated by the description of example processes and system components, and while the various processes and components have been described in detail, applicant does not intend to restrict or in any limit the scope of the appended claims to such detail. Additional modifications will also readily appear to those skilled in the art. The invention in its broadest aspects is therefore not limited to the specific details, implementations, or illustrative examples shown and described. Accordingly, departures may be made from such details without departing from the spirit or scope of applicant's general inventive concept.

What is claimed is:

1. A receipt and label combination, comprising:

a substrate including a perforation that separates the substrate into a label portion and a receipt portion, wherein the label portion and the receipt portion are of unequal sizes; and an adhesive coating applied on a backside of the substrate corresponding to the label portion, wherein the backside of the substrate corresponding to the receipt portion is adhesive free;

wherein a front side of the substrate includes a thermal coating that covers both the label portion and the receipt portion;

wherein a portion of the front side of the substrate that corresponds to the label portion includes a release coating applied over the corresponding thermal imaging coating.

2. The receipt and label combination of claim 1, wherein the adhesive coating is applied as one or more strips of adhesives on the backside of the substrate corresponding to the label portion.

* * * * *